United States Patent [19]

Miyazaki et al.

[11] 4,029,126

[45] June 14, 1977

[54] ARM DRIVING DEVICE FOR FLUID LOADING APPARATUS

[75] Inventors: Nobuto Miyazaki; Tadaya Tokahashi, both of Kanagawa, Japan

[73] Assignee: Nigata Engineering Co., Ltd., Tokyo, Japan

[22] Filed: Jan. 19, 1976

[21] Appl. No.: 650,403

[30] Foreign Application Priority Data

Mar. 14, 1975 Japan ..... 50-34424
June 5, 1975 Japan ..... 50-76340

[52] U.S. Cl. ..... 137/615; 141/387
[51] Int. Cl.[2] ..... B67D 5/00
[58] Field of Search ..... 137/615; 141/387

[56] References Cited

UNITED STATES PATENTS 3,960,176 6/1976 Chino et al. ..... 137/615

*Primary Examiner*—Alan Cohan
*Assistant Examiner*—Gerald A. Michalsky
*Attorney, Agent, or Firm*—Sughrue, Rothwell, Mion, Zinn & Macpeak

[57] ABSTRACT

An arm driving device for a fluid loading apparatus is disclosed, which comprises a V link comprised of a first link arm and a second link arm connected together rotatably at one end thereof and a hydraulic cylinder having a cylinder rod the top of which is rotatably connected to a suitable portion of either of the link arms, the other end of the first link arm being connected rotatably to a suitable portion of an extension member of an inboard arm of the fluid loading apparatus and the other end of the second link arm being connected rotatable to a suitable member fixedly connected to a stand pipe installed on land. The arm driving device may be applied to operate the outboard arm of the fluid loading apparatus with respect to the inboard arm.

5 Claims, 17 Drawing Figures

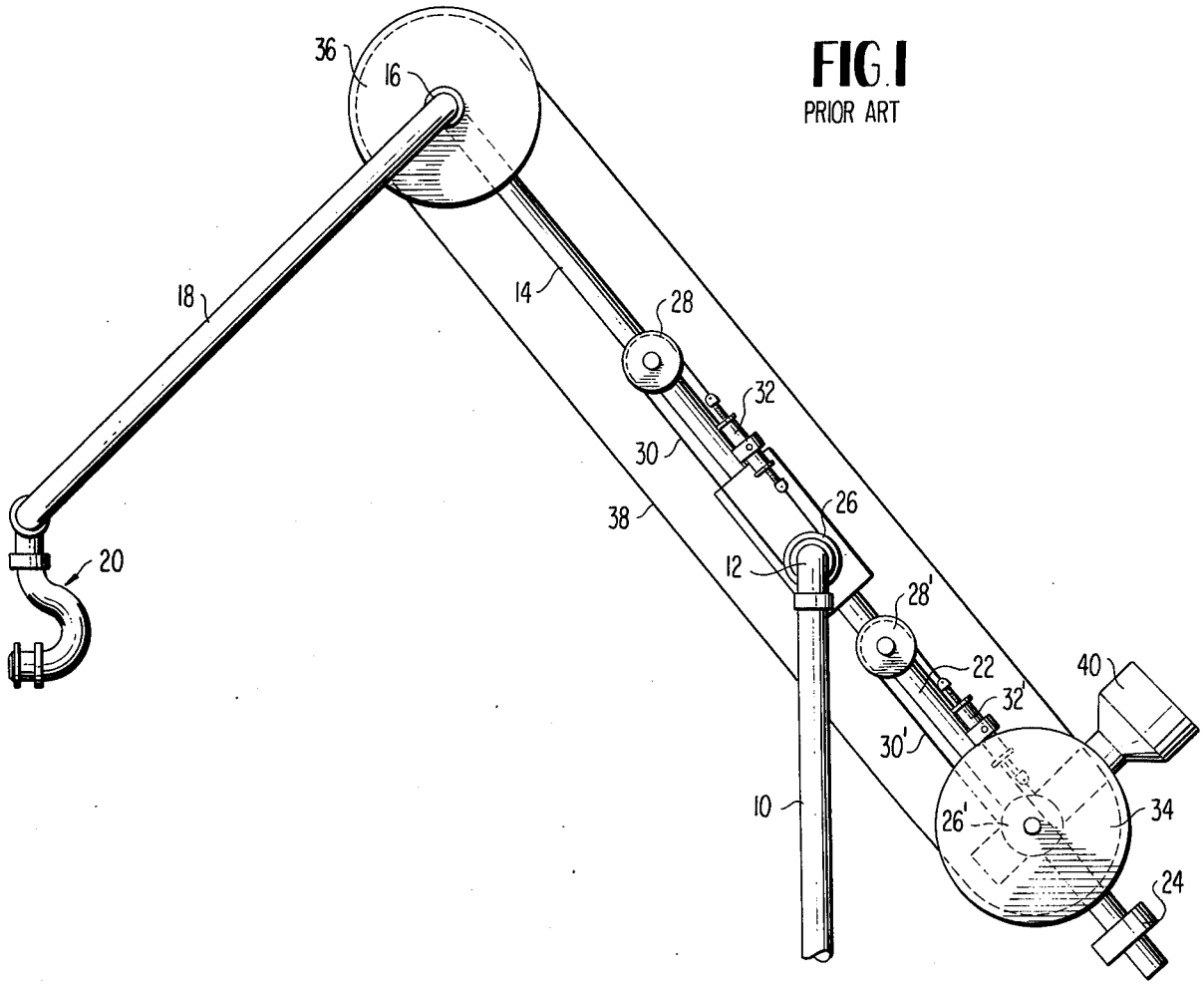
FIG. 1
PRIOR ART
FIG. 2
PRIOR ART
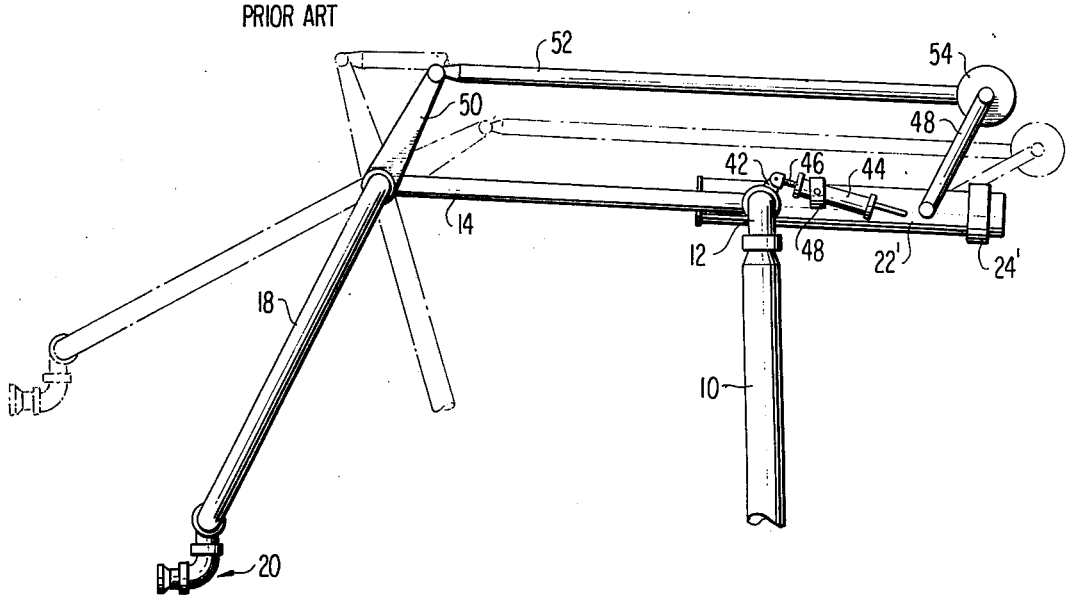

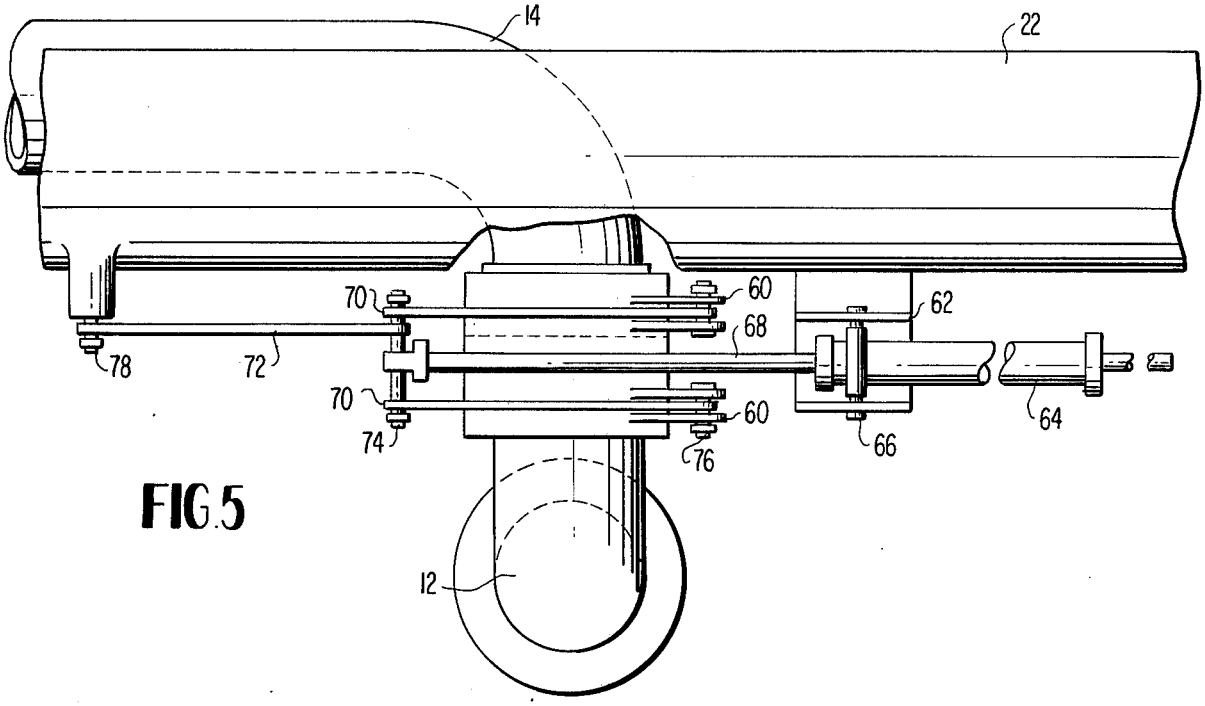
FIG.5
FIG.6(a)
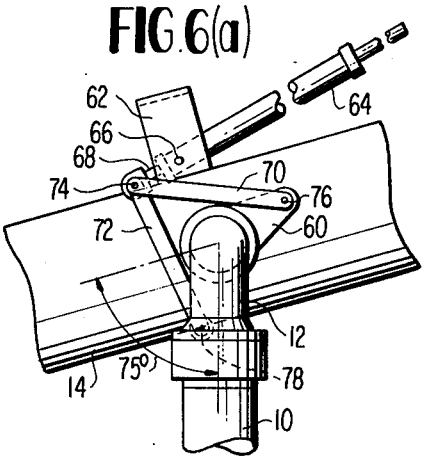
FIG.6(b)
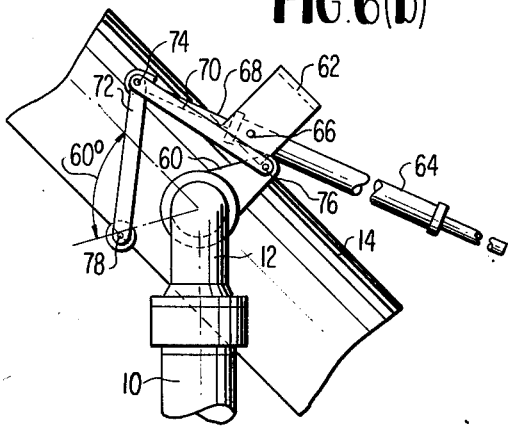
FIG.6(c)
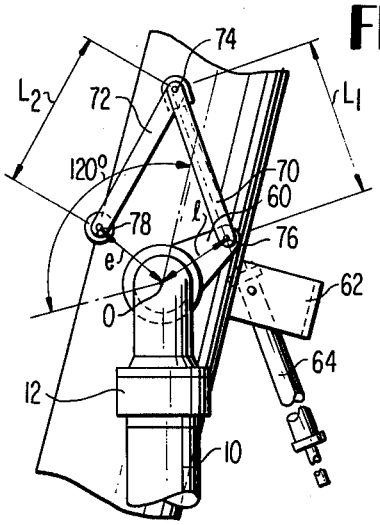
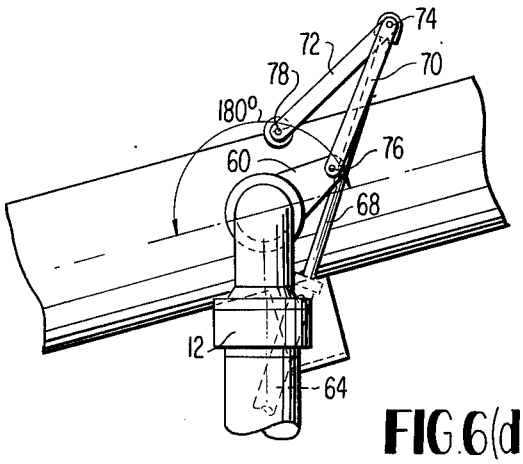
FIG.6(d)

FIG. 7(a)
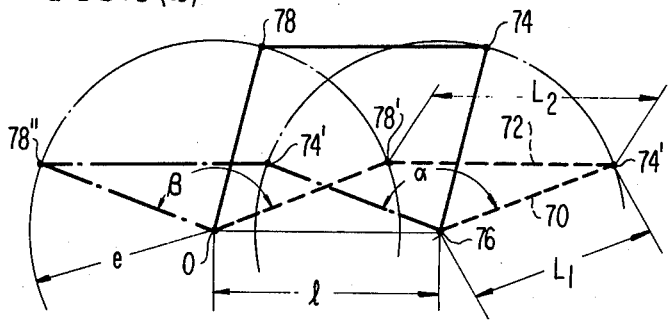
FIG. 7(b)
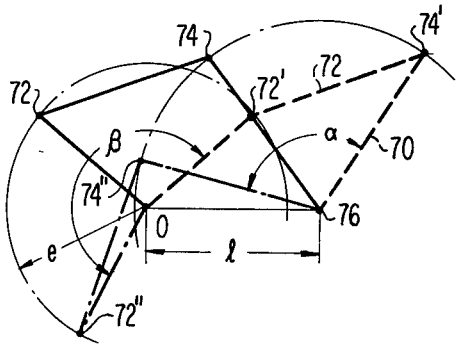
FIG. 7(c)
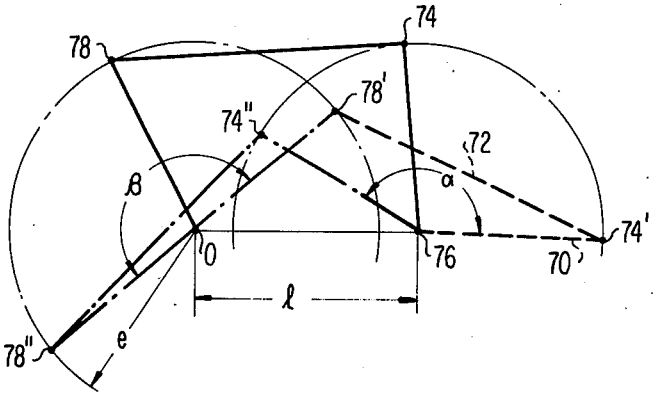
FIG. 8
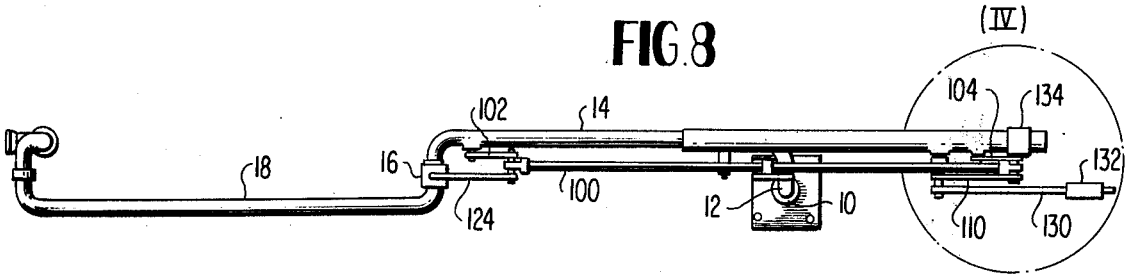
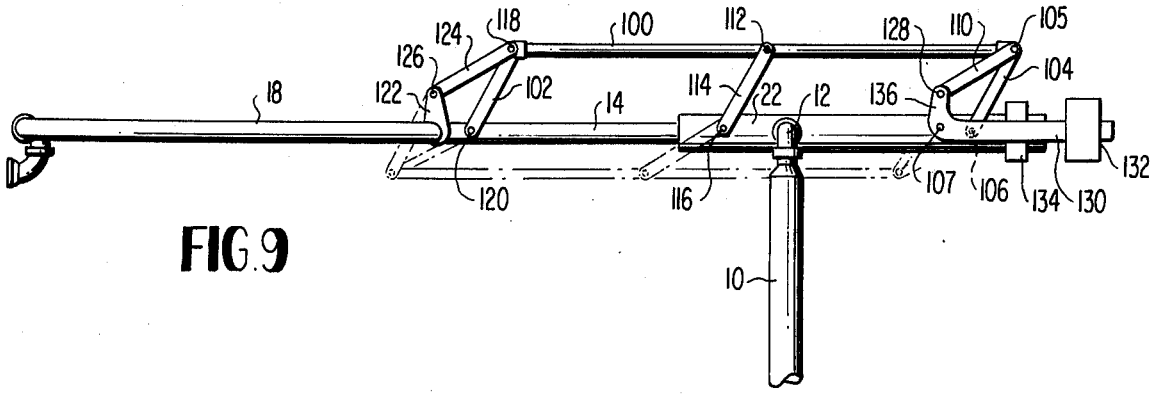
FIG. 9

ARM DRIVING DEVICE FOR FLUID LOADING APPARATUS

BACKGROUND OF THE INVENTION

1. Field of the Invention

The present invention relates to a fluid loading apparatus for use in, in particular, loading and unloading fluid from a tanker to an installation on land, and, more particularly, to a driving mechanism for driving the inboard arm and the ouboard arm of the apparatus.

2. Description of the Prior Art

It is desired for the fluid loading apparatus to make the swing range of an inboard arm thereof with respect to a stand pipe, to the top of which one end of the inboard arm is rotatably connected and of an outboard arm thereof with respect to the inboard arm, to the other end of which one end of the outboard arm is rotatably connected, as wide as 180°, respectively.

As typical driving devices for the fluid loading apparatus, which satisfy the above mentioned requirement, there are two systems, in one of which the inboard arm is rotated with respect to the stand pipe by pulling a looped wire rope or chain by means of a hydraulic motor provided in the loop and in the other of which the inboard arm is rotated with respect to the stand pipe by a hydraulic cylinder which drives the inboard arm directly. In these typical conventional systems, however, the maintenance of the wire rope or chains in the first system is very difficult because the fluid loading apparatus must be installed in salty atmosphere on shore and there is a need of frequently providing a rust resisting lubricant thereto. Furthermore, due to the elastic elongation of the wire rope, time lags may be introduced in starting and stopping rotations of the arms, resulting in some difficulty in operation. Although the second system has no disadvantages inherent to the first system, the swing angle can not be practically widened up to 180°.

Describing the conventional apparatus of these types in more detail, an example of the firstly mentioned conventional fluid loading apparatus is shown in FIG. 1.

In FIG. 1, a stand pipe 10 is provided having a lower end connected to a pipeline providing a fluid passage to a suitable reservoir on land on a fundamental structure such as a seaberth or pier. The upper end of the stand pipe 10 is connected to the inner end of an inboard arm 14 by a hollow three-dimensionally rotatable joint 12. To the outer end of the inboard arm 14, the inner end of an outboard arm 18 is connected by a hollow rotary joint 16 which is rotatable in a vertical plane. A hollow, three-dimensionally rotatable joint 20 is connected to the outer end of the outboard arm 18. The inboard arm 14 has an extension member 22 which extends from the inner end thereof and acts, together with a counterweight 24, as a balance arm. The hollow rotatable joints 12, 16 and 20 allow the fluid loading apparatus to provide a three-dimensional movement of a mainfold flange (not shown) provided on a tanker, which is connected to the outer end of the rotatable joint 20 relative to the land. A pair of wheels 26 and 28 are employed, between which a looped wire 30 is stretched. The wheel 26 is fixed to the joint 12 and the wheel 28 is rotatably connected to the inboard arm 14. The wire rope 30 is driven by an hydraulic cylinder 32 to thereby swing the inboard arm 14 with respect to the stand pipe 10. As regards the swing between the inboard arm 14 and the outboard arm 18, a pair of wheels 26' and 28', a wire rope 30' and a hydraulic cylinder 32' are used together with another pair of wheels 34 and 36, a wire rope 38 and a counter weight 40. The wheel 26' is rotatably mounted on the extension 22 of the inboard arm 14 and fixedly connected to the wheel 34 and the weight 40. The wheel 36 is fixed to the inner end of the outboard arm 18 and rotatable with respect to the outer end of the inboard arm 14. The apparatus of this type can provide an inner angle between the inboard arm and the stand pipe up to 180°. However, it is required to supply a rust resisting lubricant to the wire rope frequently for maintenance thereof and to check the breaking of filaments of the wire. Further, there is a problem that the wire is possibly elongated by the load exerted thereon as mentioned previously, causing the mechanical balance to be broken.

An example of the secondly mentioned conventional apparatus is shown in FIG. 2, in which a hydraulic cylinder 44 is rotatably secured to an extension of the inboard arm 14 and a top or end of a piston rod 46 which projects from cylinder 44 is connected to an arm 42 fixed to the joint 12. An arm lever 50 is fixedly secured to the inner end of the outboard arm 18. An outer balance arm 48 having a counterweight 54 at one end thereof is rotatably secured to the rear end portion of the extension portion 22' of the inboard arm 14 and a free end of the arm lever 50 is connected to the free end of the outer balance arm 48 by a connecting rod 52 so that, when the outboard arm 18 moves with respect to the inboard arm 14, the outer balance arm 48 is moved through the arm lever 50 and the connecting rod 52 to maintain the balance therebetween.

This fluid loading apparatus has an advantage that the maintenance is relatively easy because of the use of the connecting rod instead of the wire rope etc. However, since the load exerted on the piston rod 46 and/or the connecting rod 52 may be unreasonably increased because the length of moment arm becomes very short when the angle between the associated members becomes large, a sufficiently large inner angle (more than approximate 160°) between the inboard arm and the stand pipe and/or the two arms can not be obtained and so the operation range is relatively narrower. Further, since when the outboard arm is retracted inwardly, a compressive force is exerted on the connecting rod 52, the cross sectional area of the connecting rod and hence the buckling force thereof must be sufficiently large.

Although this structure provides an advantage in maintenance, the practical rotation angle of the inboard arm 14, about the center 0 is 120° at most as shown in FIG. 3. In order to achieve a wider rotation range, it is necessary to use a powerful hydraulic pressure cylinder having a longer stroke. This is not practical.

SUMMARY OF THE INVENTION

A primary object of the present invention is to provide a driving mechanism of the fluid loading apparatus having an outboard arm and an inboard arm one end of which is connected to one end of a stand pipe for substantially 180° of rotation range between the inboard arm and the stand pipe.

Another object of the present invention is to provide a driving device for the fluid loading apparatus, which can obtain substantially a 180° rotation range between the inboard arm and the outboard arm.

Another object of the present invention is to provide a driving mechanism of the fluid loading apparatus of the type which is not affected by elastic elongation and does not use any wire rope etc.

The above objects are achieved, according to the present invention, by a provision of a novel driving mechanism constituted with a V-link comprised of link arms; a pair of a first link arm and a second link arm connected together rotatably at one end thereof and a hydraulic having a piston rod. The other end of the first link arm is rotatably secured to a stationary member and the other end of the second link arm is rotatably secured to a member to be rotated about the stationary member. The piston rod is rotatably connected to a suitable portion of either one of the link arms so that, when the cylinder is actuated and the piston rod is moved, the one link arm is driven thereby, causing the other link arm to be rotated about the stationary member.

For the driving of the inboard arm with respect to the stand pipe, the driving mechanism is mounted on an extension member of an inboard arm which is supported rotatably in three dimensions by a stand pipe, with the free end of the first link arm being connected rotatably to the extension member and the free end of the second link arm being connected rotatably to an arm lever fixedly connected to the stand pipe. For the driving of the outboard arm with respect to the inboard arm, the free end of the first link arm is rotatably connected to a counter balance arm and the free end of the second link arm is connected rotatably to a member rotatable with respect to the extension member of the inboard arm. The latter member is mechanically ganged with another member fixedly secured to the outboard arm, so that, upon the actuation of the cylinder, the movable members rotates with respect to the inboard arm and the rotation is transmitted to the another member causing the outboard arm to be rotated about the upper end of the inboard arm.

BRIEF DESCRIPTION OF THE DRAWING

FIGS. 1 and 2 illustrate schematically side views of the conventional fluid loading apparatus respectively and a FIG. 3 shows a drive mechanism in FIG. 2 in more detail, which were already described;

FIG. 5 is a plan view of an end portion of the embodiment in FIG. 4;

FIGS. 6*a–d* illustrate the operation of the drive mechanism in FIG. 4;

FIG. 7*a–c* are explanatory illustrations showing locuses of various points of the embodiment in FIG. 6;

FIG. 8 is a plan view of another embodiment of the present invention;

FIG. 9 is a side view of the embodiment in FIG. 8;

DESCRIPTION OF THE PREFERRED EMBODIMENT

Returning now to FIGS. 4 to 7 inclusive which show an embodiment of the present invention. This embodiment utilizes a hydraulic cylinder to control the inner angle between the inboard arm and the stand pipe and between the inboard arm and the outboard arm, respectively.

Figure 3:
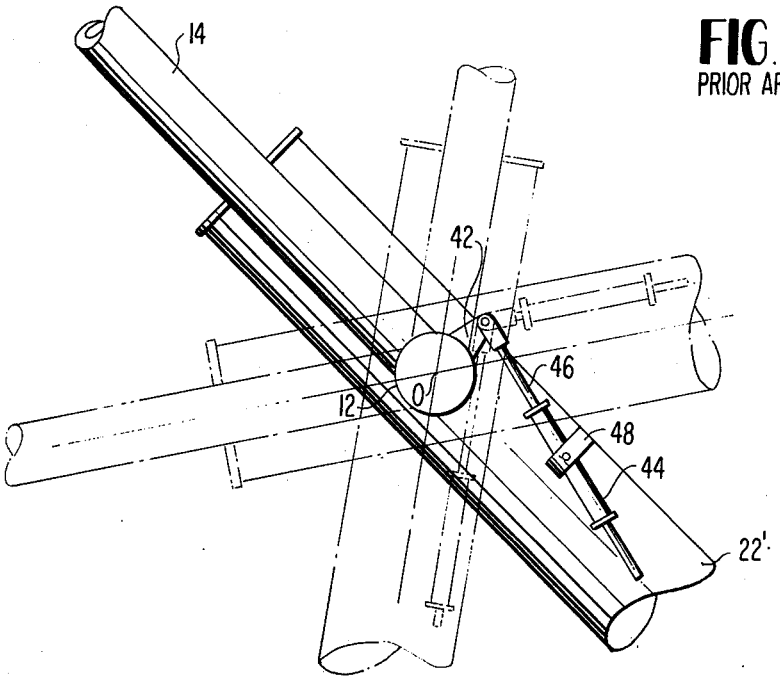
FIG. 3 PRIOR ART
Figure 4:
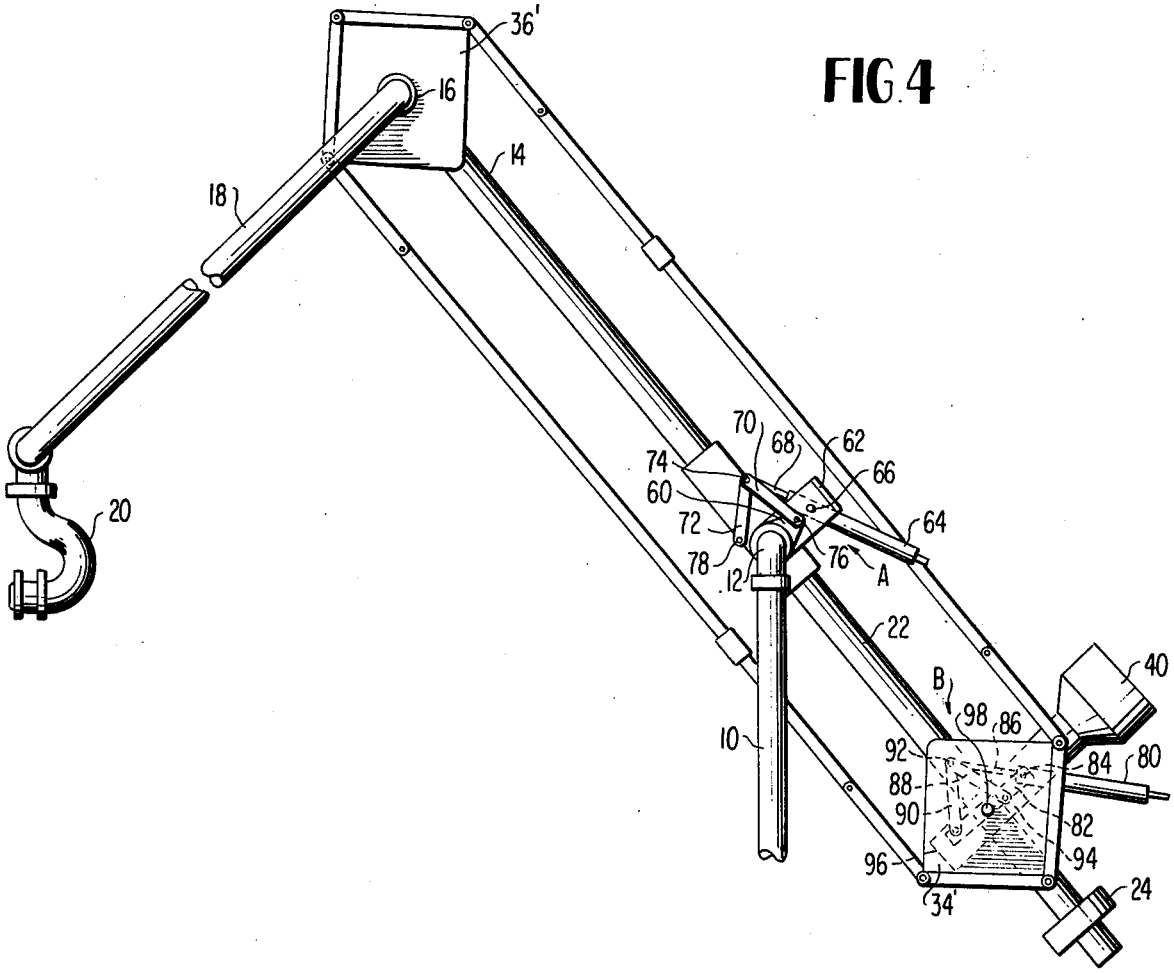
FIG. 4 is a side view of an embodiment of the present invention.

In FIG. 4 showing a side view of the embodiment, respectively, the overall construction thereof is based on the construction of the conventional apparatus such as shown in FIG. 1 of U.S. Ser. No. 476,498, now U.S. Pat. No. 3,960,176. That is, the fundamental elements, i.e., the inboard arm 14, the outboard arm 18, the stand pipe 10, the counterweights 24, 40 and the hollow joints of this embodiment are substantially the same as those shown in FIG. 1 of U.S. Pat. No. 3,960,176.

A main feature of this embodiment is that the swing of the inboard arm 14 relative to the stand pipe 10 and the swing of the outboard arm 18 relative to the inboard arm 14 are performed by similar driving mechanisms each comprising a combination of a hydraulic cylinder and V-connected link arms. The cylinder 64 of the driving mechanism A is rotatably secured on an integral member 62 of the inboard arm 14 by a shaft pin 66 and the top of the link 70 whose root end is secured rotatably by a shaft pin 76 to an integral member or torque arm 60 mounted on a hollow rotatable joint 12 and a top of the link 72 whose root end is secured rotatably by a shaft pin 78 to the inboard arm 14 are connected rotatably to a cylinder rod 68 by a shaft pin 74. FIG. 5 is a top view of the driving mechanism A in FIG. 4.

The actual vertical swing on the inboard arm 14 relative to the stand pipe 10 caused by the axial displacement of the cylinder rod 68 of the cylinder 64 of the drive mechanism A is shown in FIGS. 6*a–6d*.

When the piston rod 68 of the cylinder 64 of the mechanism A is gradually extended from the completely retracted state shown in FIG. 6(*a*), the inboard arm 14 is rotated clockwise relative to the stand pipe 10 and experiences the states shown by FIGS. 6*b* and 6*c*, in the order. When the rod 68 is completely extended as shown by FIG. 6*d*, the inboard arm 14 is rotated by 180°. This arrangement may be utilized for rotation less than 180° to reduce the cylinder stroke. This is, of course, the same for the activation of the driving mechanism B.

This link mechanism will be geometrically explained with reference to FIG. 7.

Assuming that the lengths of the links 70 and 72 are $L_1$ and $L_2$ respectively, the distance between the rotation center 0 of the inboard arm relative to the stand pipe 10 and the shaft pin 76 is l, the distance between the center 0 and the shaft pin 78 is *e* and the cylinder 64 drives the shaft pin 74, the following phenomena occur.

1. When $L_1=e$ and $L_2=l$, a rotation angle $\alpha$ of the shaft pin 74 relative to the shaft pin 76 becomes equal to a rotation angle $\beta$ of the shaft pin 78 relative to the rotation center 0, as shown in FIG. 7*a;*
2. When $L_1>e$ ($L_2=l$), the relation of the rotation angle becomes $\beta>\alpha$ as shown in FIG. 7*b* and the rotation is amplified; and
3. When $L_{22}>l$ ($L_1=e$), the angle relation becomes $\beta>\alpha$, as shown in FIG. 7*c*, and the rotation is amplified.

Therefore, in practicizing the present invention it is desirable to select the distances as $L_1>e$ and/or $L_2>l$. Although, in FIG. 6, the links 70 and 72 have the same length and the distance $l$ between the rotation center 0 of the inboard arm 14 relative to the stand pipe 10 and the shaft pin 76 is made equal to the distance $l$ between the center 0 and the pin 78, it may also be possible to select them to form other relations. Further, although in FIG. 6, the cylinder 64 is mounted on the rotation side or the inboard arm 14 and the stationary side or the inner balance arm by the shaft pin 66, it is possible to mount the driving mechanism A on the stationary side and B on the rotation side. The shaft pins 66, 78, 74 and 76 are generally supported by oil-less bearings respectively to smooth the movements thereof and facilitate the maintenance thereof.

A square cam plate 36' is fixedly secured to the inner end of the outboard arm 18 and another square cam plate 34' is provided in the end portion of the extension member of the inboard arm 14 rotatably about a mounting pin 98, implanted in the extension member 22 of the inboard arm. The cam plate 36' is adapted to trace the vertical swing of the outboard arm 18 relative to the inboard arm 14. It should be noted that, in this case, the counterweight 24 is mounted on the inner balance arm so that the attitude thereof in a vertical plane can be regulated and the counterweight 40 is mounted on an outer balance arm and fixed to the cam plate 34'. A connecting link is linked up between the cam plates. The connecting link comprises a plurality of link elements, each having a length corresponding to a side length of the cam plate, and a pair of connecting rods.

It is possible to constitute the connecting link with two link element portions and connecting rods for connecting the link element portions as shown in FIG. 4. In the same Figure, a turn buckle is provided on the way of the link for regulating the length of the connecting link. The function of the connecting link is to gang the outboard arm 18 and the outer balance arm to thereby retain a substantial balance therebetween.

The driving mechanism B for driving the outboard arm 18 with respect to the inboard arm 14 is composed of a hydraulic cylinder 80 similar to the cylinder 64 and a pair of link arms 88 and 90 similar to the link arms 70 and 72. The cylinder 80 is rotatably supported by a member 82 fixedly mounted on the extension member 22. The free end of the link arm 88 is rotatably connected to the member 82 by a shaft pin 94, the cam plate 34' is connected to the balance arm and, together with the latter, rotatably mounted on the extension member 22 by the shaft pin 98. The free end of the link arm 90 is rotatably connected to an end portion of the balance arm remote from the counter weight 40. The other ends of the link arms are jointed together by a pin 92 to which the top of the piston rod 86 is connected. By actuating the cylinder 80, the balance arm is rotated together with the cam plate 34'. The rotation of the cam plate 34' is transmitted through the connecting loop to another cam plate 36' fixedly secured to the inner end of the outboard arm 18.

The structure of the cam plates and the connecting link has advantages of simple construction and high mechanical strength, resulting in an easy maintenance. However, many modifications may be easily made on the above structure. For example, it may also be possible to construct it with a structure comprising the conventional sheeve and wire construction or a structure by which the ganged motion of the outboard arm and the outer balance arm is caused by a connecting rod.

It should be noted in FIG. 4 that although the square cam plates are preferred, other configurations of the cam plates may be utilized. It is also possible to set the cam plate 34' on a horizontal arm of the hollow rotatable joint 12.

Although, in the embodiment shown, the driving mechanism B is disposed in the side of the root end of the inboard arm 14, that is, in the side of the inner balance arm, the position of the driving mechanism B is not limited by this and it is possible to position it in the side of the top end of the inboard arm 14, and the root end of the outboard arm 18. However, where the mechanism B is provided in the shown position, a total weight of the associated members can act as a part of the counterweight 24 and therefore the reduction of weight 24 is achieved.

Figure 10:
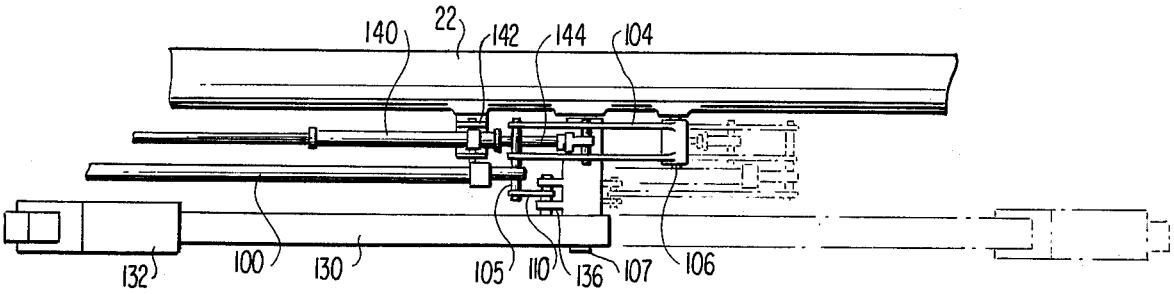
FIG. 10 is an enlarged plan view of the end portion in FIG. 9, showing another embodiment of the present invention.
Figure 11:
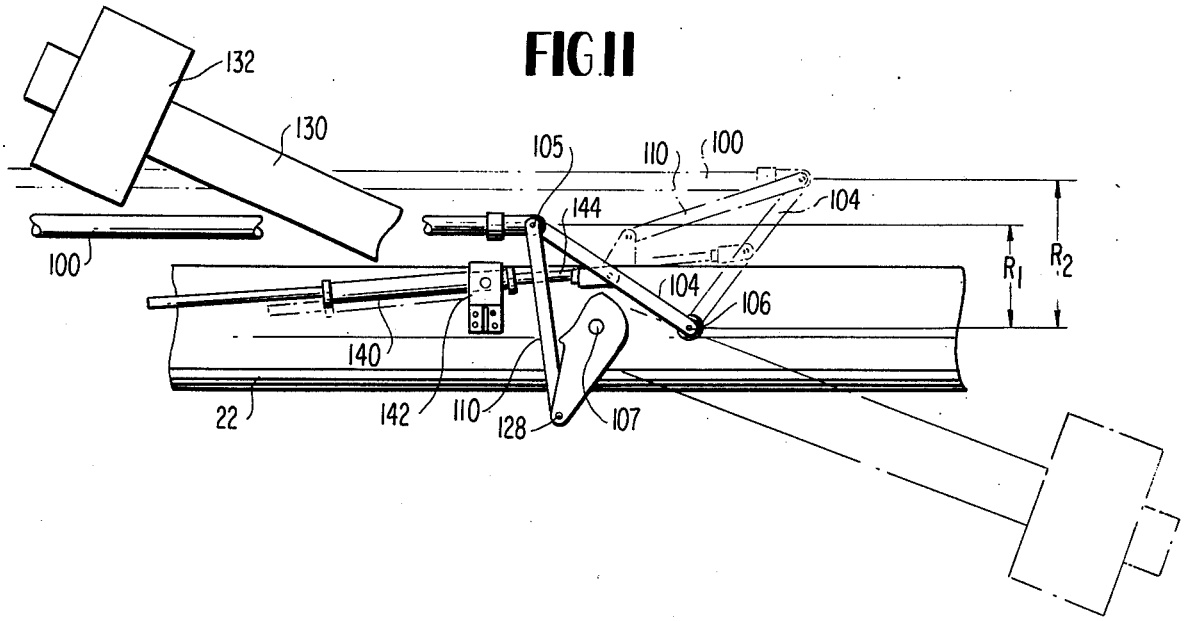
FIG. 11 is a side view of a portion of the embodiment in FIG. 10.
Figure 12:
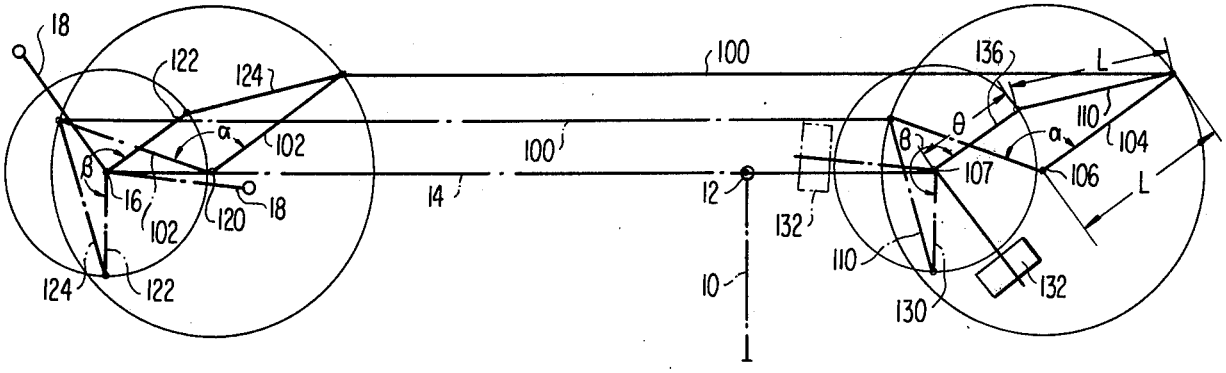
FIG. 12 is a geometrical expression of the operation of the embodiment in FIG. 9.

FIGS. 8 to 12 inclusive shows another embodiment for driving the outboard arm with respect to the inboard arm. In FIGS. 8 and 9, the driving mechanism is omitted for clarification. Rotatable arms 102 and 104 which are interconnected by a connecting rod 100 are rotatabley supported by pins 120 and 106 implanted on the inboard arm 14 at the vicinities of the top end thereof and the end of the extension member thereof, respectively. Rotatably connected between the inboard arm 14 and the connecting rod 100, which is maintained in parallel with the inboard arm 14, by pins 112 and 116 are the intermediate position thereof is an auxiliary rotatable arm 114 which is adapted to prevent the sag of the connecting rod 100 due to its own weight and to increase the buckling strength thereof against compressive force. If the length of the connecting rod 100 is relatively short, such auxiliary arm may be omitted. A link arm 124 is rotatably supported at one end thereof by the pin 118 and the other end of the link 124 is rotatably connected to a free end of the lever arm 122 by a pin 126. The lever arm 122 is fixedly secured to the outboard arm 18. The free end of the link 110 rotatably connected to the rear end of the connecting rod 100 is rotatably connected to one end of the outer balance arm 130 by a shaft pin 128, the balance arm being rotatably secured to the extension member 22 of the inboard arm 14 by a shaft pin 107. At the other end of the balance arm 130, a counterweight 132 is provided. The balance mechanism of this type can much improve the angle range between the inboard arm and the outboard arm with respect to the conventional mechanism such as shown in FIG. 2. A drive cylinder 140 is rotatably supported by a support member 142 fixedly secured to the rear position of the extension member 22 of the inboard arm 14 and an end of a piston rod 144 thereof is rotatably connected to an intermediate portion of the rotatable arm 104 as shown in FIGS. 10 and 11. The function of the rotatably supported cylinder assembly 140, 144 is to rotate the outboard arm 18 with respect to the inboard arm 14.

In operation, when the outer end of rotatable joint 20 is connected to manifold flange (not shown) provided on a tanker, the outboard arm 18 is moved according to the movement of the ship and rotated with respect to the inboard arm 14, the arm lever 122 is also rotated together with the outboard arm 18 causing the link 124 to move. By the movement of the link 124, the connecting rod 100 is moved with respect to the inboard arm 14, so that it causes the outer balance arm 130 to rotate about the pin 107 through the link 110 to maintain the balance. When the outer balance arm 130 is rotated, the outboard arm is balanced. However, as will be clear from FIG. 12, the rotation angle $\alpha$ of the rotatable arm 102 or 104 becomes smaller than the rotation angle $\beta$ of the lever arm 122 and hence the outboard arm 18. Therefore, it is possible to enlarge the maximum inner angle between the inboard arm and the outboard arm so that the operation range thereof is widened. In practice, since it is possible to make $\alpha$=90° for the inner angle $\beta$=180° by designing the ratio in length of the link 102 or 104 to the arm 122 or 136 as $L/\epsilon$=2/1, the compressive force exerted on the connecting rod 100, when the outboard arm 18 is retracted, is ordinary because the length of moment arm does not becomes too short and therefore, there is no need of making the cross-sectional area thereof large to provide a sufficient mechanical strength and this is advantageous in economy. By the use of oil-less metal for each of the portion around the respective shaft pins the maintenance are facilitated.

The connecting rod 100 and the rotatable arms 102 and 124, etc., may be mounted in lower side of the inboard arm 14 as shown by chain lines in FIG. 9 or it may be possible to mount them in both the upper side and the lower side. Further, although it is preferred to rotatably connect the junctions of links 124 and 102 and of 104 and 110 to the connecting rod 100 by means of the pins 105 and 118, it may be possible to connect the rod 100 to other portions than the junctions of the rotatable link arms, such as, for example, to suitable portions of extensions of the rotatable arm 124 and 110 or 102 and 104, provided that the inboard arm and the connecting rod are maintained in parallel.

Further, the top or projecting end end of the cylinder rod 144 may be connected to any position between the pins 105 and 106 of the front link 104 to the portion of the pin 105 of the link 104 or to the auxiliary rotatable arm 114.

The embodiment utilizes one drive cylinder driving the inboard arm together with a link mechanism arranged in V, a connecting rod and the inboard arm. The structure provides many advantages over the conventional driving mechanism using a drive cylinder and a direct drive of the outboard arm as shown in FIG. 1 or 2. That is, the maintenance of the apparatus is facilitated and the rotation range of the outboard arm with respect to the inboard arm can be made large enough, providing a smooth operation thereof.

The fluid loading apparatus according to the present invention is utilized by connecting the stand pipe to a fluid transporting pipe provided in the seaberth and connecting the hollow rotatable joint 20 to the manifold on the tanker as in the conventional manner, the operation thereof is very easy because the driving mechanism for rotating the inboard arm and the outboard arm is constructed with the cylinders and a pair of links so that the rotation angle becomes as much as 180°. Further, since the links do not require frequent provisions of rust-resisting lubricant in comparison with the conventional wire rope or chain, the maintenance is facilitated and it can provide a simple structure having sufficient mechanical strength.

While the invention has been described in detail and with reference to specific embodiments thereof, it will be apparent to one skilled in the art that various changes and modifications can be made therein without departing from the spirit and scope thereof.

What is claimed is:

1. In a fluid loading apparatus, comprising a hollow inboard arm having one end connected for rotation in three-dimensions to a hollow stand pipe implanted on land and having an extension member to form an inner balance arm, a hollow outboard arm connected at one end thereof to the other end of said inboard arm for rotation in a vertical plane with respect thereto and having at the other end thereof a three dimensionally rotatable joint, an outer balance means and an operation means for controlling the angle between said inboard arm and said stand pipe, an improvement characterized in that said operation means comprises a first hydraulic cylinder supported rotatably by said inboard arm and having a piston rod; and a first V-link comprised of a pair of first and second link arms connected rotatably with each other at one end thereof, said first hydraulic chamber cylinder having a projecting end of said piston rod rotatably connected to a suitable portion of said link arms, the other end of said first link arm being connected rotatably to a suitable portion of said inboard arm, and the other end of said second link arm being connected rotatably to said stand pipe.

2. The fluid loading apparatus according to claim 1, further comprising a second hydraulic cylinder supported suitably and having an extendable piston rod and a second V-link comprised of a first and second link arm connected rotatably with each other at one end thereof, a projecting end of said piston rod of said second cylinder being rotatably connected to a suitable portion of said link arms of said second V-link, the other end of said first link arm of said second V-link being connected rotatably to a suitable portion of said extension member, the other end of said second link arm of said second V-link being rotatably connected to a suitable portion of said outer balance means, a first means fixedly connected to said one end of said outboard arm and a second means mechanically interconnecting said balance means and said first means.

3. A fluid loading apparatus according to claim 2, characterized in that said outer balance means comprises a lever pivotably supported by said portion of said extension member and having one end connected to said the other end of said second link arm and the other end connected to a counterweight.

4. The fluid loading apparatus according to claim 3, wherein said first means is a polygonally cornered cam member and said balance means includes a polygonally cornered cam member identical to said first cam member and said second means is a loop chain connecting said two cam members and constituted by multiple chained rod members connected together by a pair of parallel rods, and each of said chained rod members having a length corresponding to one side length of the polygon so that said chained rod members mesh with said cam members.

5. The fluid loading apparatus according to claim 1, further comprising a first means fixedly connected to one end of said outboard arm and a second means mechanically interconnecting said balance means and said first means, and wherein said first means is a lever arm and said second means is a connecting rod interconnecting said balance means and said lever arm.

* * * * *